US006688818B2

(12) United States Patent
Bishop

(10) Patent No.: US 6,688,818 B2
(45) Date of Patent: Feb. 10, 2004

(54) COLLAPSIBLE ASSEMBLY FOR TRANSPORTING VEHICLES IN A CONTAINER

(75) Inventor: Darrell L. Bishop, Jacksonville, FL (US)

(73) Assignee: Vehicle Transport, Inc., Jacksonville, FL (US)

( * ) Notice: Subject to any disclaimer, the term of this patent is extended or adjusted under 35 U.S.C. 154(b) by 0 days.

(21) Appl. No.: 10/075,353

(22) Filed: Feb. 14, 2002

(65) Prior Publication Data

US 2003/0152435 A1 Aug. 14, 2003

(51) Int. Cl.[7] ..... B60P 7/00
(52) U.S. Cl. ..... 410/26; 410/4; 410/24
(58) Field of Search ..... 410/4, 24, 26; 414/298; 211/192, 195, 208, 85.8; 220/1.5

(56) References Cited

U.S. PATENT DOCUMENTS 4,911,590 A * 3/1990 Green ..... 410/26
5,110,242 A * 5/1992 Chance ..... 410/26
5,213,458 A * 5/1993 Preller et al. ..... 410/26
5,286,149 A * 2/1994 Seay et al. ..... 410/26
5,344,266 A * 9/1994 Kolb ..... 410/26
5,427,485 A * 6/1995 Henderson et al. ..... 410/26
5,454,672 A * 10/1995 Halpin et al. ..... 410/26
5,489,171 A * 2/1996 Claps et al. ..... 410/26
5,595,465 A * 1/1997 Knott ..... 410/24
5,775,858 A * 7/1998 Bacon ..... 410/26
5,797,712 A * 8/1998 Gearin et al. ..... 40/16
6,010,285 A * 1/2000 Cox et al. ..... 410/26
6,196,776 B1 * 3/2001 Pienaar et al. ..... 410/26

FOREIGN PATENT DOCUMENTS

DE 4019-011 A * 12/1991 ..... 220/1.5

* cited by examiner

*Primary Examiner*—Stephen T. Gordon
(74) *Attorney, Agent, or Firm*—Arthur G. Yeager

(57) ABSTRACT

A collapsible assembly for loading and transporting vehicles in a cargo container having a roof, a floor, two elongate side walls, and front and rear walls, includes two pairs of spaced vertical posts, one pair being at the front end of the frame and another pair being at the rear end. Front and rear horizontally mounted crossbars support two ramps for carrying a vehicle when the assembly is in its open position. Each crossbar has two members of equal length rotatably and slideably attached to the posts and connected together by a hinge that allows each crossbar to be folded in half interiorly of the frame thus pulling the posts together in a collapsed closed position for storage purposes.

20 Claims, 9 Drawing Sheets

COLLAPSIBLE ASSEMBLY FOR TRANSPORTING VEHICLES IN A CONTAINER

CROSS REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to stowage systems and methods for carrying vehicles in a container, and particularly to collapsible assemblies.

2. Description of Related Art

Several systems have been developed to transport vehicles in containers. Many systems are expensive and inefficient because they require auxiliary power units for electric, pneumatic, hydraulic, or forklift vehicle-handling apparatus.

The prior systems are cumbersome and take up a great deal of space even when disassembled. Moreover, the prior art systems are very complex and expensive and can require several people for setup and takedown.

BRIEF SUMMARY OF THE INVENTION

In one aspect of the present invention there is provided a collapsible assembly for loading and transporting vehicles in a substantially rectangular container having a roof, a floor, two elongate side walls, an end wall and a door comprising a frame including a front end and a rear end, the frame further including two pairs of spaced vertical post members, one pair being at the front end of the frame and another pair being at the rear end of the frame. Each post member has an upper end portion and a lower end portion to which is mounted a respective front and rear horizontal crossbar by way of first means for mounting the crossbars horizontally between the post members. A ramp means having a rear end portion and a front end portion is removably mountable on the crossbars. Each crossbar includes a first and second crossbar member having first and second end portions and means for connecting the first end portion of the first crossbar member to the first end portion of the second crossbar member. The means for mounting the respective front and rear crossbar to respective post members includes means for mounting the second end portions of the crossbar members to respective post members.

The means for mounting the second end portions of the crossbar members includes means for rotatably mounting the crossbar members to respective front and rear post members and for slideably mounting the crossbar members to respective front and rear post members. The first and second crossbar members are of substantially equal length.

The assembly has an open position for carrying a vehicle on the ramp means and a closed position for storing the assembly, the frame defining an interior space when the assembly is in said open position. The means for connecting the first end portions of respective crossbar members includes hinge means for folding the crossbar members inwardly into the interior space when the assembly is moved from the open position to the closed position. The means for mounting the second end portions of respective crossbar members includes means for selectively adjusting the vertical position of the crossbar members for selectively controlling the angle and height of the ramp means secured to the crossbars.

In other aspects of the present invention there is provided a collapsible assembly for loading and transporting vehicles in a substantially rectangular container having a roof, a floor, two elongate side walls, an end wall and a door comprising a frame having a front end and a rear end, the frame including two pairs of spaced vertical post members, one pair being at the front end of the frame and another pair being at the rear end of the frame. Each post member has an upper end portion and a lower end portion. There are front and rear horizontal crossbars, and first means for mounting the front crossbar horizontally between the post members at the front end of the frame and second means for mounting the rear crossbar horizontally between the post members at the rear end of the frame. A ramp means is included having a rear end portion and a front end portion removably mountable on the crossbars. Each crossbar includes a first and second crossbar member having first and second end portions and hinge means for connecting the first end portion of the first crossbar member to the first end portion of the second crossbar member and the first and second means for mounting respective front and rear cross to respective front and rear post members incilding means for mounting the second end portions of the first and second crossbar members to respective front and rear post members. The means for mounting the second end portions of the first and second crossbar members includes means for rotatably and slideably mounting the first and second crossbar members to the respective front and rear post members.

The first and second crossbar members are of substantially equal length. The assembly has an open position for carrying a vehicle on the ramp means and a closed position for storing the assembly, the frame defining an interior space when the assembly is in the open position and a closed position for storing the assembly, the crossbar being folded inwardly about the hinge means in the closed position. There is also securing means for securing folded crossbars to the frame to inhibit movement of the folded crossbars when the assembly is in the closed position. Also included is securing means for removably affixing the ramp means to said assembly and for attaching the front end portion of the ramp means to the front crossbar. The means for mounting the second end portions of the respective crossbar members includes means for selectively locating each crossbar independently to the respective post member at a plurality of selectable heights above the floor of a container for selectively controlling the angle and height of the ramp means secured to the crossbars.

In a further aspect of the present invention there is provided a collapsible assembly for loading and transporting vehicles in a substantially rectangular container having a roof, a floor, two elongate side walls, an end wall and a door comprising a frame having a front end and a rear end, the frame including two pairs of spaced vertical post members, one pair being at the front end of the frame and another pair being at the rear end of the frame and each post member has an upper end portion and a lower end portion. A front and rear horizontal crossbar is included and there is first means for mounting the front crossbar horizontally between the post members at the front end of the frame and second means for mounting the rear crossbar horizontally between the post members at the rear end of the frame. The ramp means has a rear end portion and a front end portion and securing means is connected between one end portion of the ramp means and one crossbar for securing one end portion of the ramp means to one crossbar. The assembly has an open position for carrying a vehicle on the ramp means and a closed position for storing the assembly, and each crossbar includes a first and second crossbar member having first and second end portions and hinge means for connecting the first end portion of the first crossbar member to the first end portion of the second crossbar member. The crossbars are foldable about the hinge means when the assembly is in the closed position. Also included is first and second means for mounting the respective front and rear cross to the respective front and rear post members for rotatably and slideably mounting the second end portions of the first and second crossbar members to the respective front and rear post members. There is also means for securing the frame to a floor of a container.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

Figure 1:
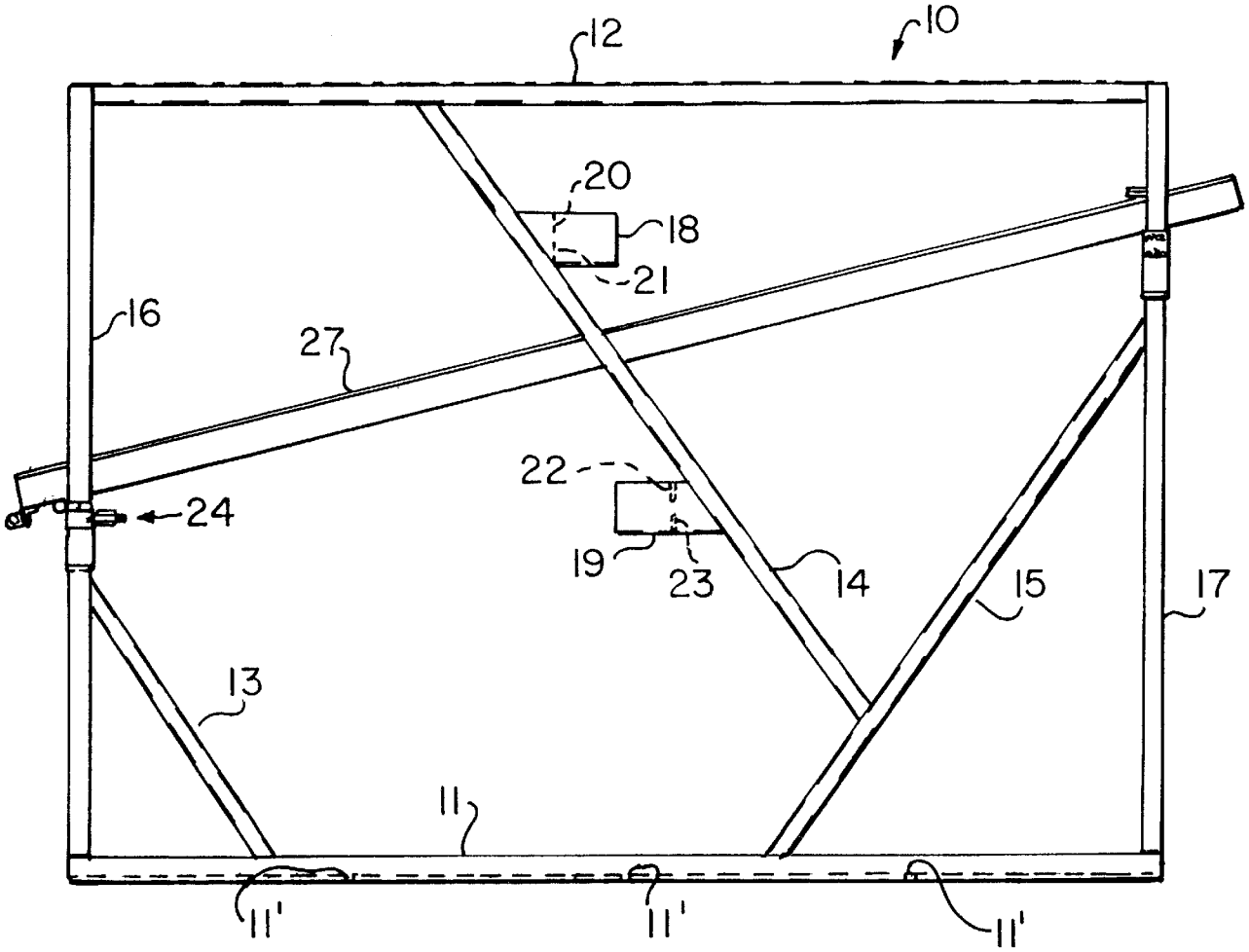
FIG. 1 is a side-elevation view of the collapsible assembly in accord with the present invention shown carrying a vehicle ramp.

With respect now to the drawings, the collapsible assembly set up for use for carrying a vehicle is illustrated at numeral 10 in FIG. 1. The assembly 10 is comprised of a frame having two spaced L-shaped lower frame members 11 and two spaced upper frame members 12. Two spaced telescoping front post members 16 and two spaced telescoping rear post members 17 are rigidly connected between the end portions of the lower and upper members 11 and 12 respectively. Three pairs of spaced strut members 13, 14, and 15 provide additional rigidity and strength Cor assembly 10.

An upper flange 18 and lower flange 19 provide a securing member for the respective rear and front hinge apparatus via members 20, 21 and 22, 23 respectively, as will be explained hereinbelow. Front 24 and rear 25 securing apparatus for a pair of spaced ramps 27 and height adjustment means 26 will also be described hereinbelow.

Figure 2:
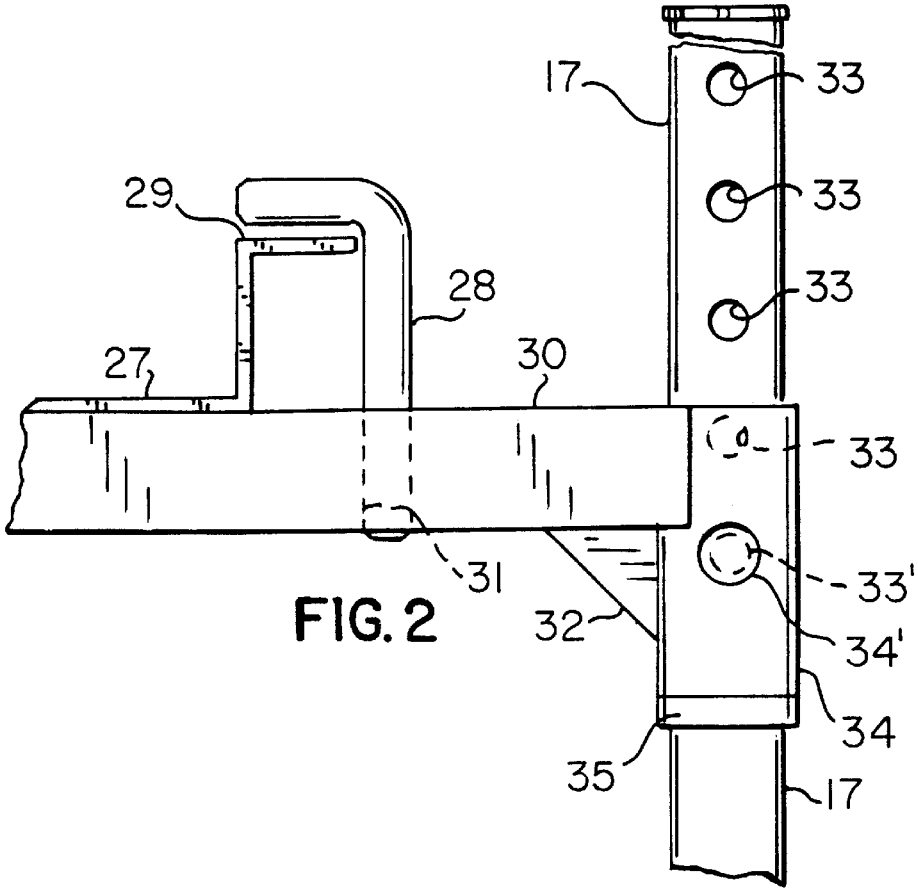
FIG. 2 is a partial elevation of the rear securing apparatus for a ramp and the height adjustment apparatus used in FIG. 1.

In FIG. 2, a partial detail of one end of a crossbar 25 or 26 is illustrated. Crossbar member 30 is welded to a sleeve or collar member 34 that is slidable and rotatable. Sleeve member 34 is movable upwardly above stop 35 to allow a pin 33' to be inserted through aligned holes 33 and 34' to adjust the height of member 30 above stop 35 which is affixed to the lower portion of post 17.

Pin 28 is used to secure a ramp 27 (shown only pictorially) to crossbar 26. Pin 28 is shaped to pit into hole 31 and rest on top of ramp lip 29. Gusset 32 provides for additional strength.

Figure 3:
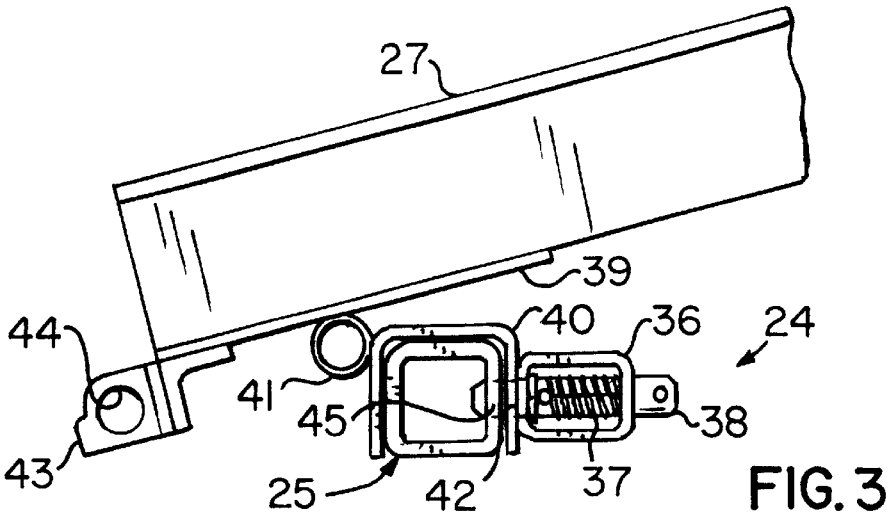
FIG. 3 is a side elevation of the front securing apparatus for a ramp.

FIG. 3 illustrates how the lower end of a ram 27 is secured to front crossbar members 30 and 47. Lock pin 38 is carried by bracket 36 and is biased via spring 37. Pin 38 fits through a hole 45 in front crossbar 25. Support plate 40 is welded to hinge 41 to which is also welded support plate 39. Pin 38 fits through hole 42 in support plate 39. Apparatus 24 allows for adjustments of the mounting angle between ramp 27 and front crossbar 25 as the height of the rear crossbar 26 is changed without removing a ramp 27 from the crossbars 25, 26.

Figure 4:
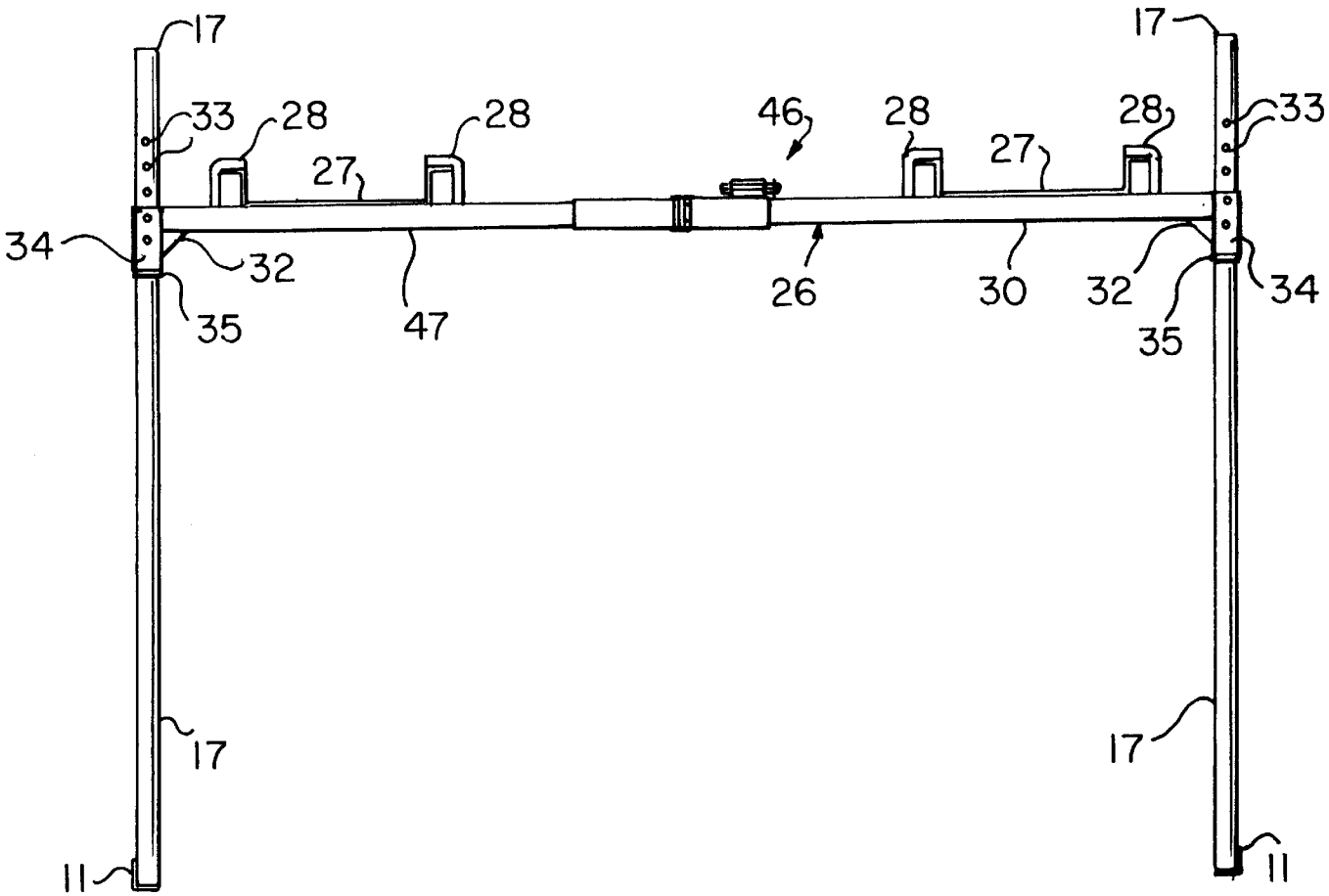
FIG. 4 is a rear elevation view of the rear crossbar showing the location of the vehicle ramps.

In FIG. 4, rear crossbar 26 is shown from the rear mounted between rear posts 17. Crossbar 26 includes two members 30 and 47 and hinge apparatus 46 that provides an articulated linkage means between the members 30, 47. Ramps 27 are shown only pictorially to illustrate their relative position.

Figure 5:
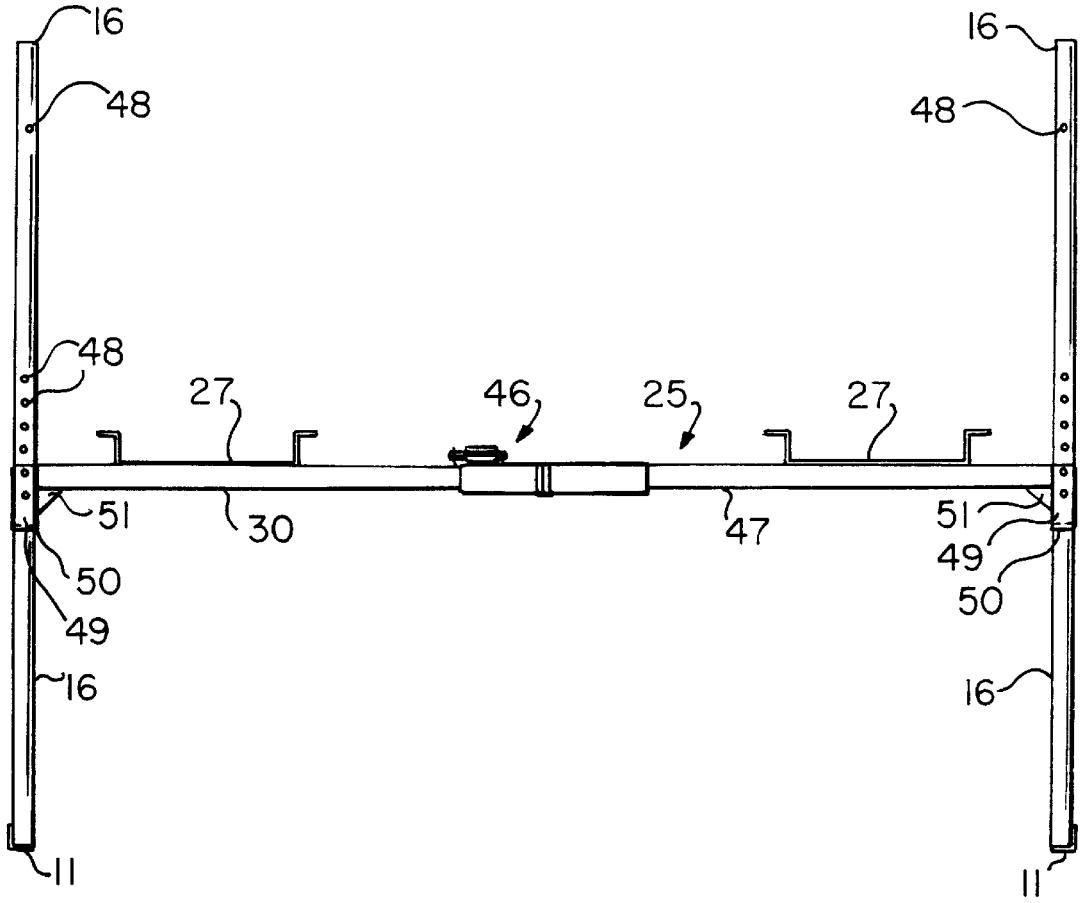
FIG. 5 is a front elevation of the front crossbar.

FIG. 5 provides a front view of front crossbar 25 mounted between front posts 16.

Preferably, crossbars 25 and 26 are identical. In addition, front posts 16 are identical. In addition, front posts 16 are preferably identical with rear posts 17 and include gusset 51, sleeve portion 49 and stop 50, otherwise identical to the height adjustment apparatus of posts 17 with the exception that the lower portion of each front post 16 is shorter than the lower portion of rear post 17.

Figure 6:
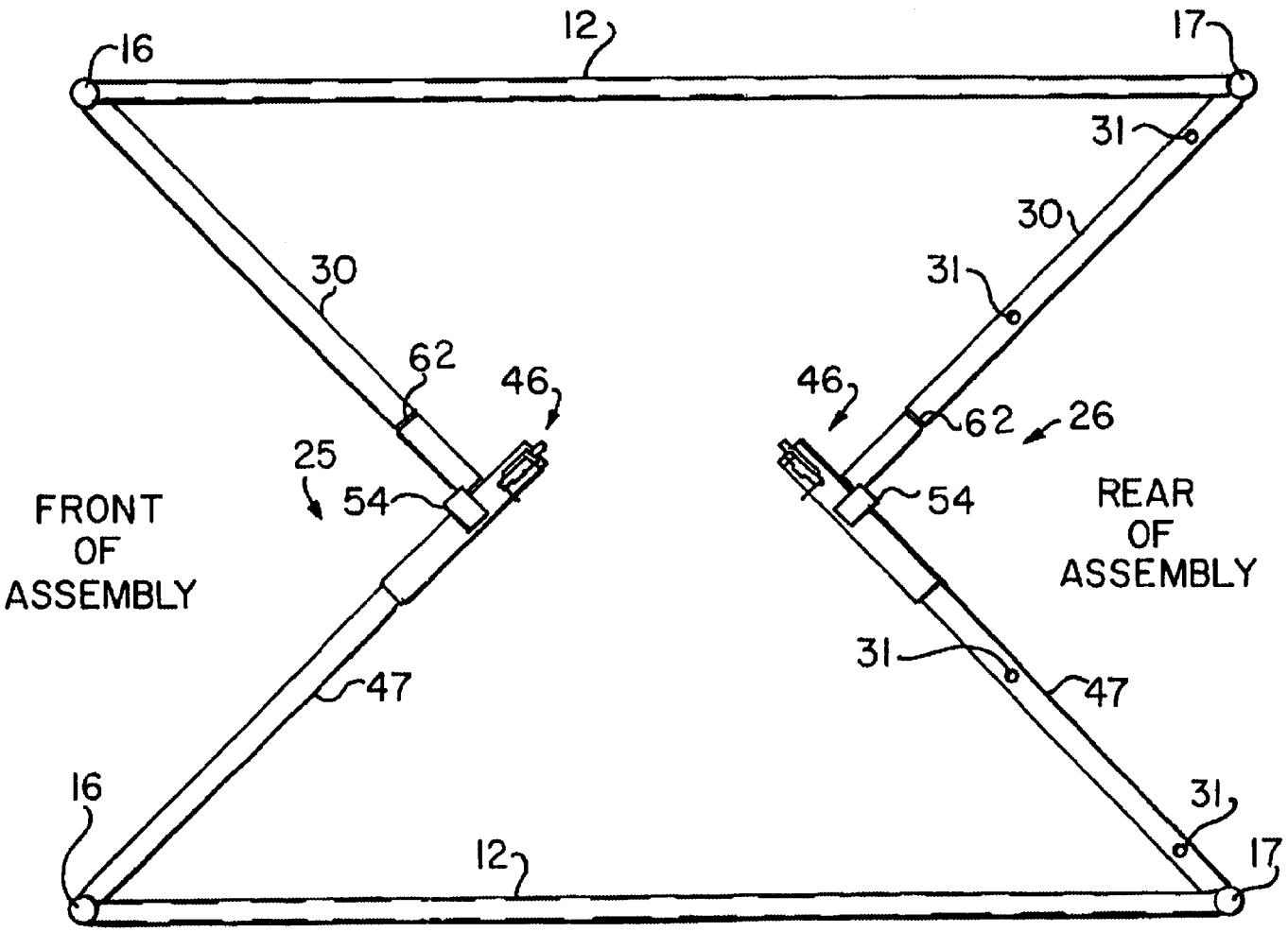
FIG. 6 is a top view of the crossbars of FIGS. 4 and 5 shown partially closed and connected to the upper frame members.

In FIG. 6 a top view of the assembly 10 is shown partially collapsed. Each crossbar 25, 26 folds via hinge apparatus 46 thus drawing the upper frame members 12 and lower frame members 11 closely together inwardly in a parallel manner with crossbars 25, 26 essentially folded in half and positioned between the lower and upper members 11 and 12.

Figure 7:
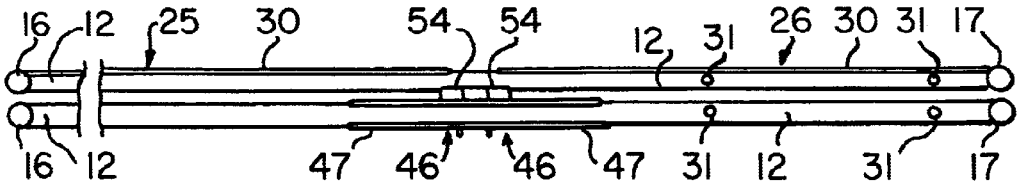
FIG. 7 is a top view of the assembly shown in collapsed form.

FIG. 7 illustrates a top view of the assembly 10 that has been collapsed to a width of approximately 5" for storage purposes.

Figure 9:
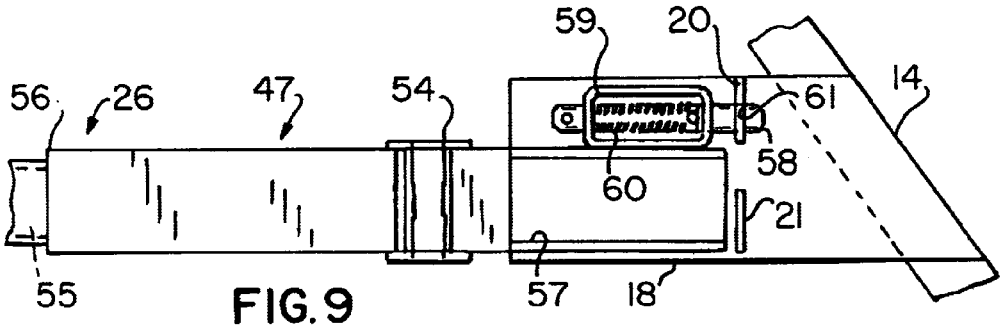
FIG. 9 is a detail of the center-hinged portion of a crossbar in the closed position of FIG. 7.
Figure 8:
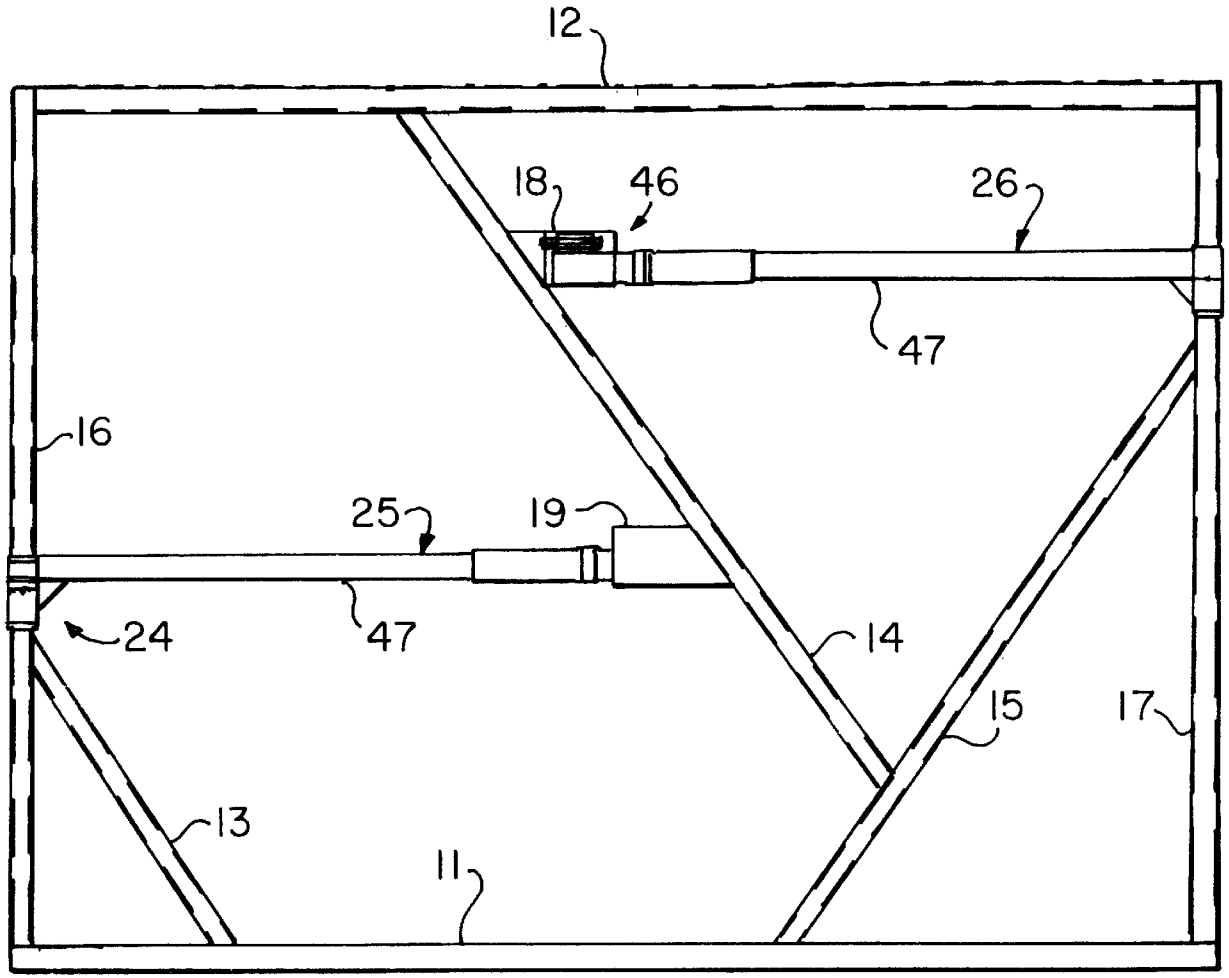
FIG. 8 is a side view of the assembly in a closed position.

FIGS. 8 and 9 illustrate a side view of the assembly 10 that has been collapsed for storage 112 purposes. The hinge apparatus 46 is secured to a respective flange 18, 19 by positioning a locking pin 38 through respective locking lock plate 20 and 22 via opening 61 (FIG. 9).

FIGS. 9–12 illustrate the hinge apparatus used in the present invention. Each crossbar 25, 26 has each end portion welded to a respective sleeve 34. Medially of each crossbar 25 and 26 the two members 30 and 47, having respective end portions 56 and 55, which are of substantially equal length are connected via a hinge apparatus 46. Hinge 54 provides for 1800 movement of member 30 while member 47 is simultaneously rotated 900 to collapse the assembly 10 to the position shown in FIGS. 7 and 8.

Hinge apparatus 46 includes a U-shaped channel member 57 into which fits an interior end portion 56 of crossbar member 30 when the crossbar 25 or 26 has been fully opened in order to use assembly 10. The placement of end portion 56 into channel 57 provides strength for the crossbar 215 or 26. Lock plate 62 is welded onto end portion 56. Lock pin 58, carried by bracket 59 and biased via spring 60, is inserted through the opening 64 in plate 62 to secure end 56 in place via handle 63. See also FIG. 12.

Figure 11:
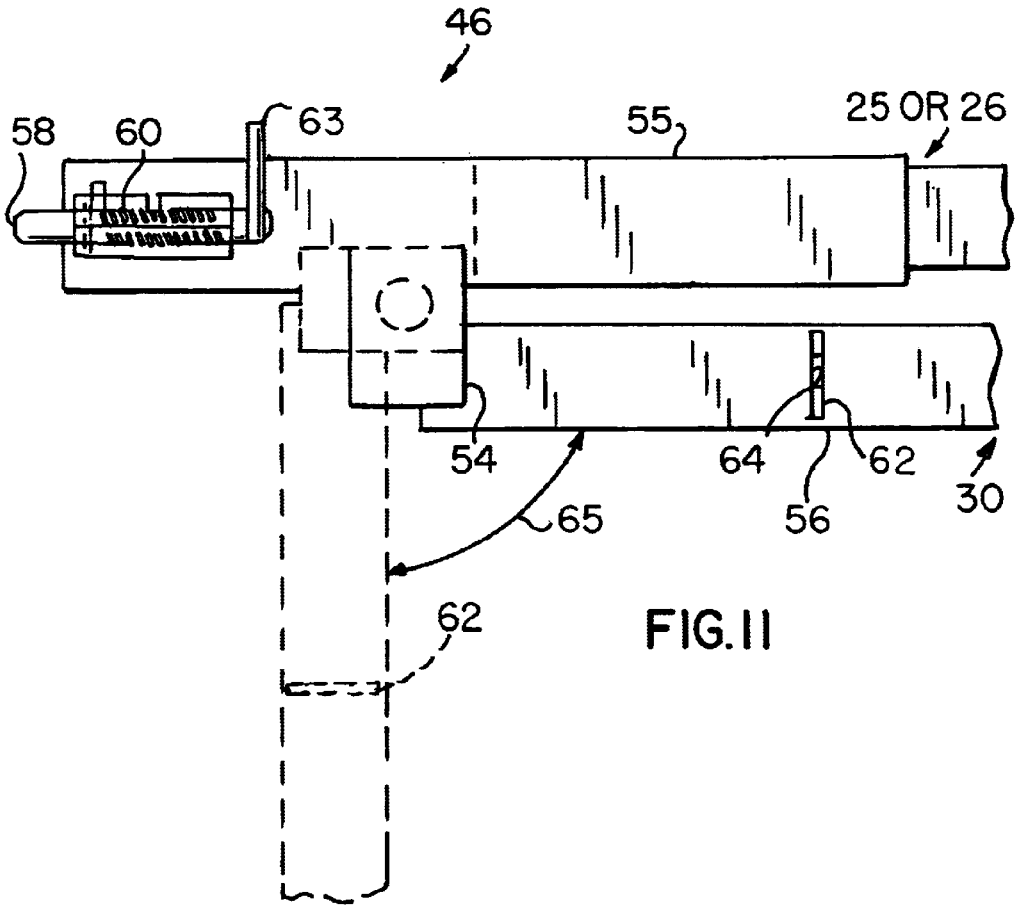
FIG. 11 is a top view of the hinged portion of a crossbar with a partially closed position in broken line and a fully closed position in solid line.

FIG. 11 illustrates the movement of member 30 from the broken line position (shown in FIG. 6) to the completely closed position in solid line as indicated by arrow 65 where the member 30 is folded for securing as illustrated in FIG. 9.

Figure 13:
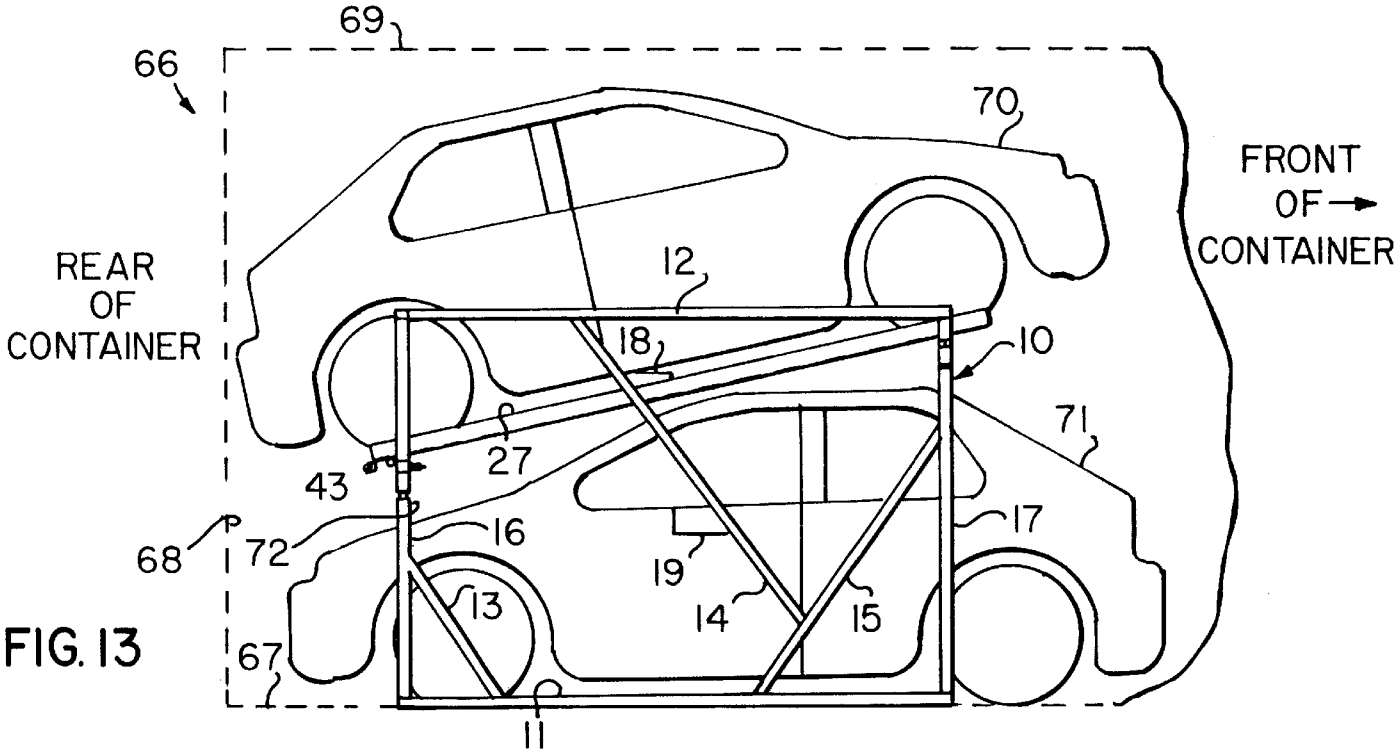
FIG. 13 is a side view of an assembly in accord with the present invention mounted in a cargo container and carrying a vehicle.

FIG. 13 illustrates the use of an assembly 10 for carrying vehicle inside a cargo container. Container 66 has roof 69, rear wall 68 and floor 67. Vehicle 70 is driven onto ramps 27 using a temporarily used loading ramp (not shown) connected to the ramps 27 via loading ramp attachment 43 (FIG. 3) and secured via locking pin slot 44 as understood in the art. The space underneath ramps 27 and crossbars 25, 26 allows for the storage of vehicle 71 (or other goods). The number of assemblies 10 used depends on the length of container 66.

In the preferred embodiment, assembly 10 is 69 inches high and 7 feet 10½ inches long and 88½ inches wide (as measured between the centerlines of the front or rear posts). The maximum height of the rear crossbar 26 is 63 inches from the floor and the lowest position is 55 inches. The maximum height of front crossbar 25 is 32½ inches in normal use. Interior space 72 is defined by posts 16, 17 and frame members 11, 12, 13, 14 and 15 and is large enough to accommodate a vehicle and other apparatus that may be carried in container 66. Front crossbar 25 is raised to upper hole 48 in order to provide for the loading of the lower vehicle 71.

Figure 10:
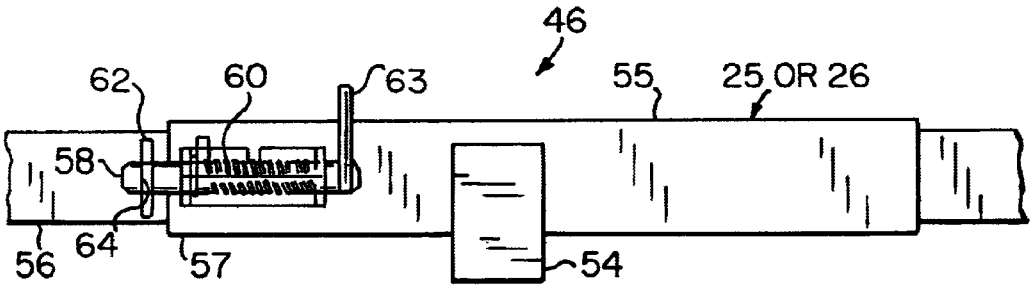
FIG. 10 is a detail of the top of the hinged portion of a crossbar in the open position.
Figure 12:
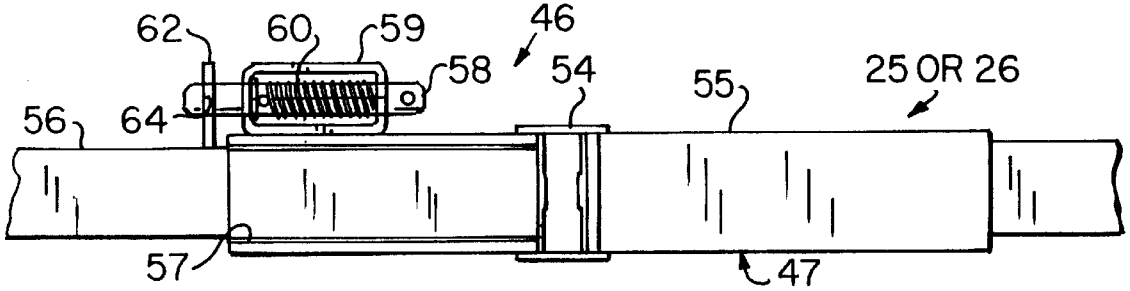
FIG. 12 is a side view of the hinged portion of a crossbar in the open posi tion.

In summary, the assembly 10 is stored as shown in FIGS. 7 and 8. The assembly 10 is opened by releasing lock pins 58 from the respective lock plates 20 and 22. The assembly 10 can then be pulled outwardly open to the position shown in FIG. 6 and then fully opened where pins 58 are inserted in the lock plate 62 (FIGS. 10, 12). Crossbars 25 and 26 can then be positioned at the desired height via pins 34'. Ramps 27 are then placed on the crossbars 25, 26 at the locations indicated in FIGS. 4 and 5.

When installed in a cargo container 66 the assembly 10 can be secured in place by way of a means including a spaced series of bolts or driven nails through pre-drilled holes 11' in lower frame members 11 into the wood flooring of such container, as understood in the art.

Takedown of the assembly 10 is the reverse process. Pins 58 are removed from lock plates 62 and the crossbars 25, 26 are then pulled and folded inwardly to collapse the assembly to the position illustrated in FIGS. 7 and 8.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

What is claimed is:

1. A collapsible assembly for loading and transporting vehicles in a substantially rectangular container having a roof, a floor, two elongate side walls, an end wall and a door comprising a frame including a front end and a rear end, said frame further including two pairs of spaced vertical post members, one said pair being at said front end of said frame and another said pair being at said rear end of said frame, each said post member having an upper end portion and a lower end portion, a front and rear horizontal crossbar, first means for mounting said front crossbar horizontally between said post members at said front end of said frame, second means for mounting said rear crossbar horizontally between said post members at said rear end of said frame, ramp means having a rear end portion and a front end portion removably mountable on said crossbars, each said crossbar including a first and second crossbar member having first and second end portions and means for connecting said first end portion of said first crossbar member to said first end portion of said second crossbar member, said first and second means for mounting said respective front and rear crossbar to respective said front and rear post members including means for mounting said second end portions of said first and second crossbar members to respective said front and rear post members.

2. The assembly as defined in claim 1 wherein said means for mounting said second end portions of said first and second crossbar members includes means for rotatably mounting said first and second crossbar members to said respective front and rear post members.

3. The assembly as defined in claim 1 wherein said means for mounting said second end portions of said first and second crossbar members includes means for slideably mounting said first and second crossbar members to said respective front and rear post members.

4. The assembly as defined in claim 1 wherein said means for mounting said second end portions of said first and second crossbar members includes means for rotatably and slideably mounting said first and second crossbar members to said respective front and rear post members.

5. The assembly as defined in claim 1 wherein said first and second crossbar members are of substantially equal length.

6. The assembly as defined in claim 1 wherein said means for connecting said first and second portions of each respective first and second crossbar member includes hinge means.

7. The assembly as defined in claim 1 wherein said assembly has an open position for carrying a vehicle on said ramp means and a closed position for storing said assembly, said frame defining an interior space when said assembly is in said open position.

8. The assembly as defined in claim 7 wherein said means for connecting said first end portions of respective first and second crossbar members includes hinge means for folding said crossbar members inwardly into said interior space when said assembly is moved from said open position to said closed position.

9. The assembly as defined in claim 1 wherein said means for mounting said second end portions of respective said crossbar members includes means for selectively adjusting the vertical position of said crossbar members for selectively controlling the angle and height of said ramp means secured to said crossbars.

10. A collapsible assembly for loading and transporting vehicles in a substantially rectangular container having a roof, a floor, two elongate side walls, an end wall and a door comprising a frame having a front end and a rear end, said frame including two pairs of spaced vertical post members, one said pair being at said front end of said frame and another said pair being at said rear end of said frame, each said post member having an upper end portion and a lower end portion, a front and rear horizontal crossbar, first means for mounting said front crossbar horizontally between said post members at said front end of said frame, second means for mounting said rear crossbar horizontally between said post members at said rear end of said frame, ramp means having a rear end portion and a front end portion removably mountable on said crossbars, each said crossbar including a first and second crossbar member having first and second end portions and hinge means for connecting said first end portion of said first crossbar member to said first end portion of said second crossbar member, said first and second means for mounting said respective front and rear crossbars to respective said front and rear post members including means for mounting said second end portions of said first and second crossbar members to respective said front and rear post members.

11. The assembly as defined in claim 10 wherein said means for mounting said second end portions of said first and second crossbar members includes means for rotatably and slideably mounting said first and second crossbar members to said respective front and rear post members.

12. The assembly as defined in claim 10 wherein said first and second crossbar members are of substantially equal length.

13. The assembly as defined in claim 10 wherein said assembly has an open position for carrying a vehicle on said ramp means and a closed position for storing said assembly, said frame defining an interior space when said assembly is in said open position and a closed position for storing the assembly, each said crossbar being folded inwardly about said hinge means in said closed position.

14. The assembly as defined in claim 13 further including securing means for securing folded said crossbars to said frame to inhibit movement of said folded crossbars when said assembly is in said closed position.

15. The assembly as defined in claim 10 further including securing means for removably affixing said ramp means to said assembly.

16. The assembly as defined in claim 15 wherein said securing means includes attaching means for attaching said front end portion of said ramp means to said front crossbar.

17. The assembly as defined in claim 10 wherein said means for mounting said second end portions of respective said crossbar members includes means for selectively locating each said crossbar independently to a respective said post member at a plurality of selectable heights above the floor of a container for selectively controlling the angle and height of said ramp means secured to said crossbars.

18. A collapsible assembly for loading and transporting vehicles in a substantially rectangular container having a roof, a floor, two elongate side walls, an end wall and a door comprising a frame having a front end and a rear end, said frame including two pairs of spaced vertical post members, one said pair being at said front end of said frame and another said pair being at said rear end of said frame, each said post member having an upper end portion and a lower end portion, a front and rear horizontal crossbar, first means for mounting said front crossbar horizontally between said post members at said front end of said frame, second means for mounting said rear crossbar horizontally between said post members at said front end of said frame, second means for mounting said rear crossbar horizontally between said post members at said rear end of said frame, ramp means having a rear end portion and a front end portion, securing means connected between one said end portion of said ramp means and one said crossbar for securing said one end portion of said ramp means to said one crossbar, said assembly having an open position for carrying a vehicle on said ramp means to said one crossbar, said assembly having an open position for carrying a vehicle on said ramp means and a closed position for storing said assembly, each said crossbar including a first and second crossbar member having first and second end portions and hinge means for connecting said first end portion of said first crossbar member to said first end portion of said second crossbar member, said crossbars being foldable about said hinge means when said assembly is in said closed position, said first and second means for mounting said respective front and rear crossbars to respective said front and rear post members including means for rotatably and slideably mounting said second end portions of said first and second crossbar members to respective said front and rear post members.

19. The assembly as defined in claim 18 further including means for securing said frame to a floor of a container.

20. The assembly as defined in claim 16 wherein said securing means includes a hinge attached to respective said ramp means to permit upward and downward movement of said front crossbar without removal of said ramp means.

* * * * *